US007544046B2

(12) United States Patent
Beyer et al.

(10) Patent No.: US 7,544,046 B2
(45) Date of Patent: Jun. 9, 2009

(54) VACUUM PUMP

(75) Inventors: Christian Beyer, Köln (DE); Christian Harig, Köln (DE); Rainer Hölzer, Hürth (DE); Alois Greven, Erkelenz (DE); Hermann Boy, Kerpen (DE)

(73) Assignee: Oerlikon Leybold Vacuum GmbH, Cologne (DE)

( * ) Notice: Subject to any disclaimer, the term of this patent is extended or adjusted under 35 U.S.C. 154(b) by 834 days.

(21) Appl. No.: 10/512,026

(22) PCT Filed: Apr. 15, 2003

(86) PCT No.: PCT/EP03/03891

§ 371 (c)(1),
(2), (4) Date: Oct. 19, 2004

(87) PCT Pub. No.: WO03/089791

PCT Pub. Date: Oct. 30, 2003

(65) Prior Publication Data

US 2005/0129535 A1 Jun. 16, 2005

(30) Foreign Application Priority Data

Apr. 20, 2002 (DE) ..... 202 06 267 U

(51) Int. Cl.
*F04B 53/00* (2006.01)

(52) U.S. Cl. ..... 417/234; 417/2; 417/313

(58) Field of Classification Search ..... 417/2, 417/17, 313, 234

See application file for complete search history.

(56) References Cited

U.S. PATENT DOCUMENTS

| | | | | |
|---|---|---|---|---|
| 5,491,831 | A * | 2/1996 | Williams et al. | 455/66.1 |
| 5,772,403 | A * | 6/1998 | Allison et al. | 417/44.2 |
| 6,211,632 | B1 | 4/2001 | Liao | 318/16 |
| 6,533,168 | B1 * | 3/2003 | Ching | 235/375 |
| 6,544,228 | B1 * | 4/2003 | Heitmeier | 604/131 |

FOREIGN PATENT DOCUMENTS

| | | | |
|---|---|---|---|
| DE | EP0664399 | * | 7/1995 |
| DE | 196 05 132 | | 8/1997 |
| EP | 0 664 399 | | 7/1995 |
| EP | 0664399 | * | 7/1995 |
| EP | 1 146 231 | | 10/2001 |

OTHER PUBLICATIONS

Turinsky "IR-Sende -und IR-Empfangsmodems für Industriesteuerungen" 2421 Radio Fernsehen Electronik 41 (1992) No. 2, Berlin, DD, pp. 127-129.

* cited by examiner

*Primary Examiner*—Charles G Freay
*Assistant Examiner*—Peter J Bertheaud
(74) *Attorney, Agent, or Firm*—Fay Sharpe LLP

(57) ABSTRACT

A vacuum pump (10) includes a pump unit (14) and an operating unit (12) arranged spaced from the pump unit (14). The operating unit (12) is connected with the pump unit (14) for controlling it. The pump unit (14) and the operating unit (12) respectively comprise a transceiver module (20,22) for transmitting and receiving control and operational data bidirectionally in a wireless manner. The pump unit (14) and the operating unit (12) are exclusively connected with each other in a wireless manner. By the omission of electrical lines, the induction of interfering signals is excluded. Wall perforations for lead-through of electrical lines are omitted.

11 Claims, 1 Drawing Sheet

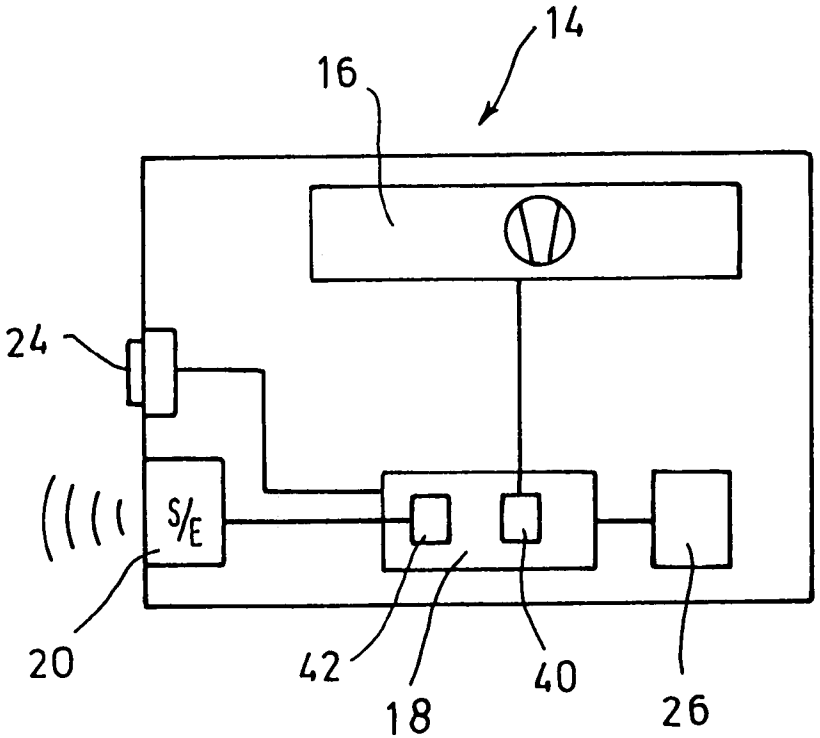
14
16
26
40
18
42
S/E
24
20
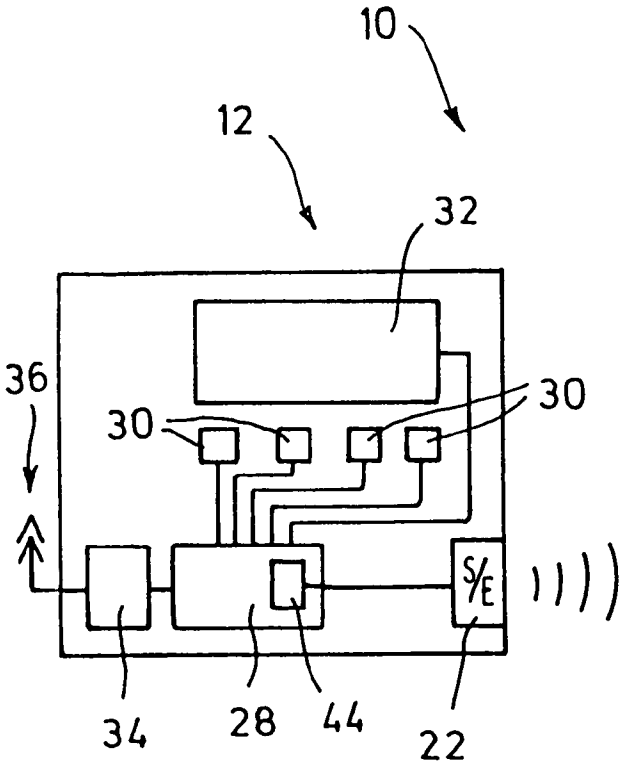
10
12
32
30
30
S/E
22
44
28
34
36

VACUUM PUMP

BACKGROUND OF THE INVENTION

The invention relates to a vacuum pump comprising a pump unit and an operating unit set up so as to be spaced therefrom and a method for controlling a vacuum pump.

In a plurality of plants with vacuum pumps, the pump unit comprising a pumping set and the operating unit for operating the pump unit are spaced from each other. Examples for that are factories for flat glass coating, clean-room plants, glass fiber production plants, cathode ray tube production plants, elementary particle accelerators and the like. The connection between the operating unit and the pump unit consists of electric data and control lines via which the control and check signals are transferred between the pump unit and the operating unit. The electric data lines, however, are susceptible to induced interfering impulses, particularly if the lines are very long. Further, control and data lines may require line ducts through walls which are difficult to seal. In case of moving pumps, the signals have to be transferred via long trailing lines and/or sliding contacts.

It is the object of the invention to improve the transfer of control and check signals between the operating unit and the pump unit with a vacuum pump.

SUMMARY OF THE INVENTION

In the vacuum pump according to the invention, the pump unit and the operating unit respectively comprise a transceiver module for the wireless continuous transmission and reception of control and operational data in both directions. The pump unit and the operating unit are exclusively connected with each other in a wireless manner, i.e., there is no electric control line between the operating unit and the pump unit any more. Upon installing the vacuum pump, no lines have to be installed any more. By the omission of the lines, the induction of interfering signals is virtually excluded. Wall perforations for the lead-through of lines are omitted as well. Thus, the installation of the vacuum pump is considerably facilitated. Further, the interference-liability of the data link between the operating unit and the pump unit is reduced.

According to a preferred embodiment, the pump unit comprises a pump control and a supervisory module for the continuous supervision of the pump unit transceiver module. The pump control switches the pumping set to a safety mode when the supervisory module detects an interruption of the continuous reception of a control signal continuously transmitted to the operating unit by the pump unit. As soon as the continuous transmission between the operating unit and the pump unit is interrupted, the pump control switches the pumping set to a safety mode. Thereby, when the wireless transmission is disturbed, the pumping set is immediately brought into a safe operational state in which a threat to persons or a production plant connected thereto is excluded and a destruction of the pumping set can be avoided, respectively.

The supervision of the wireless transmit-receive operation is effected continuously, i.e., in a tight time-slot pattern of a few seconds at maximum.

Preferably, the operating unit also comprises a supervisory module continuously supervising the reception of the transceiver module and continuously inducing the transmission of a control signal as long as a fault-free reception is detected. When the supervisory module of the pumping set does not receive a correct control signal, it transmits a safety mode signal to the pump control. Thus, it is ensured that only in case of an uninterrupted transmission between the pump unit and the operating unit as well as between the operating unit and the pump unit, the control signal can be received in the pump unit and the pumping set runs in normal operation. As soon as the transmission is interrupted somewhere, the pump unit does not receive a control signal any more whereupon the pumping set is immediately switched to a safety mode.

According to a preferred embodiment, the transceiver modules are configured as radio modules via which a wireless radio link between the pump unit and the operating unit exists. The advantage of the wireless radio link is that it is also adapted to be established through walls and/or over great distances. Thus, several vacuum pumps are able to be controlled and checked independently of each other in a large area without any problem.

As an alternative, the transceiver modules can also be configured as wireless infrared modules via which the wireless data link is realized. Such optical data transfers are completely immune to interferences with respect to induced signals as may occur with high load working currents with steep current and voltage edges in the respective plant.

Preferably, the pump unit or the operating unit comprises a wireless telephone module. By the wireless telephone module, it is made possible to check the pumps and/or the operating unit from a remote maintenance center. Thus, error analyses can be made, new parameters for the control of the vacuum pump or operational instructions for the control of the vacuum pump can be transferred from the maintenance center.

According to a preferred embodiment, the pump unit or the operating unit comprises a position determination module. A GPS module is a receiver receiving the radio signals of various geostationary navigation satellites and evaluating them for determining its own position. The position determination module provides information signals about its precise location. By reading out the location signals, the respective position of the operating unit and the pump unit, respectively, can be determined.

According to a method according to the invention for controlling a vacuum pump comprising a pump unit with a pumping set and an operating unit spaced from the pump unit, the pump unit and the operating unit being connected with each other bidirectionally and exclusively in a wireless manner, the following method steps are provided:

- continuously transmitting from the pump unit to the operating unit and vice versa,
- continuously supervising the reception in the pump unit and in the operating unit,
- operating the pumping set in a safety mode when an interruption of the continuous reception in the pump unit and/or in the operating unit is detected.

By the continuous supervision of the wireless transmission in both directions, it is ensured that even in case of short-term disturbances in the wireless transmission in one of the two transmission directions, the pumping set is immediately switched to a safety mode in which a threat, destruction or damage by the pumping set is excluded, particularly if critical operational data or control data with important control instructions are not transmitted because of the interrupted transmission.

According to a preferred embodiment, the method according to the invention comprises the following method steps:

- continuously transmitting a control signal from the operating unit to the pump unit as long as a fault-free reception in the operating unit is detected,
- continuously supervising the reception of the control signal in the pump unit, and operating the pumping set in a safety mode when no control signal is received.

By introducing a continuous control signal of the operating unit, a simple method is created that ensures a continuous supervision of the wireless connection between the pump unit and the operating unit in both transmission directions in a simple manner.

Still further advantages of the present invention will be appreciated to those of ordinary skill in the art upon reading and understand the following detailed description.

BRIEF DESCRIPTION OF THE DRAWINGS

Hereinafter, an embodiment of the invention will be explained in detail with reference to the drawing.

The FIGURE shows a vacuum pump comprising a pump unit and an operating unit.

DETAILED DESCRIPTION OF THE PREFERRED EMBODIMENTS

In the FIGURE, a vacuum pump 10 is illustrated which includes a pump unit 14 with a pumping set 16, and an operating unit 12. The operating unit 12 and the pump unit 14 are spaced from each other, the operating unit is arranged in a control center and the pump unit at the site of production or use, for example.

Besides the pumping set 16, the pump unit 14 comprises a control module 18 by which the control of the pumping set 14 and the remaining modules is performed. Further, the pump unit 14 comprises a transceiver module 20 configured as a radio module. Furthermore, the pump unit 14 comprises a plug 24 connected with the control module 18 via control lines. Via the plug 24, the pump unit 14 is also adapted to be controlled and maintained via a non-illustrated operating apparatus connected to a control line in case of failure of the radio control.

The operating unit 12 comprises a display 32 for displaying control and operational data. The operating unit 12 also comprises a control module 28 by which all the modules and units of the operating unit 12 are controlled. The operating unit 12 comprises control keys 30 by which corresponding data inputs can be made manually. Further, the operating unit 12 comprises a transceiver module 22 configured as a radio module and operating at the same frequency as the transceiver module 20 of the pump unit 14. The two transceiver modules 20,22 operate according to the Blue Tooth or the wireless LAN IEEE 802.11 standard or another standard.

Finally, the operating unit 12 comprises a wireless telephone module 34 that is also connected with the control module 28. The wireless telephone module 34 operates according to the GSM standard, but may also operate according to the HDCSD, GPRS, UMTS or another wireless telephone standard.

The pump unit 14 comprises a position determination module 26 signaling, continuously or on request, the location of the module 26 and thus the location of the pump unit 14 to the control module 18. The position determination module 26 is configured as a GPS receiver, but is also able to determine the position in another manner.

Through the two transceiver modules 20,22, the control and check of the pump unit 14 is performed by the operating unit 12 in a wireless manner. Operational data detected in the pump unit 14 are transmitted via the control module 18 and the transceiver module 20 to the operating unit 12 as well as corresponding control or request signals from the control module 28 of the operating unit 12 are transmitted via the transceiver module 22 to the pump unit 14.

Further, the wireless telephone module 34 can be called from a non-illustrated maintenance center to receive and send corresponding maintenance and control data from the operating unit 12 and to the operating unit 12, respectively, which transmits them further to the pump unit 14, if necessary.

In both directions, the wireless connection between the operating unit 12 and the pump unit 14 is checked continuously, i.e., in a time-slot pattern of a few seconds at maximum. This is even done if no control or operational data at all are exchanged between the pump unit 14 and the operating unit 12. To this end, the operating unit 12 comprises a supervisory module 44 in its control module 28, which is connected with the transceiver module 22 of the operating unit 12. The pump unit 14, in turn, also comprises a supervisory module 42 as well as a pump control 40 in its control module.

The supervisory module 42 of the pump unit 14 regularly induces the transceiver module 22 of the pump unit 14 at intervals of a few seconds at maximum to emit a presence signal. This presence signal is received by the transceiver module 22 of the operating unit 12 and transferred to the supervisory module 44. The supervisory module 44 evaluates the received presence signal and induces the transceiver module 22 to transmit a control signal. This control signal is received by the transceiver module 22 of the pump unit and transferred to the supervisory module 42 for evaluation. The control signal is evaluated in the supervisory module 42. If the control signal arrives within a defined time slot, a new presence signal is put out.

If the control signal does not arrive in the predetermined time slot or no control signal at all arrives, the supervisory module 42 transmits a corresponding signal to the pump control 40 which immediately sets the pumping set 16 to a safety mode, i.e., usually sets back the pumping set 16 to a low speed or else switches it off completely.

By the continuous supervision of the wireless connection between the operating unit 12 and the pump unit 14 in both directions, it is ensured that upon disturbances, a malfunction of the pumping set is forestalled by the fact that the pumping set is immediately brought into the safety mode. With vacuum pumps, this is particularly useful because vacuum pumps are usually used in sensitive processes, e.g., in the generation of a vacuum in the chip production, upon the evacuation of cathode ray tubes or with other production processes and experiments occurring under vacuum.

The invention has been described with reference to the preferred embodiments. Modifications and alterations may occur to others upon reading and understanding the preceding detailed description. It is intended that the invention be constructed as including all such modifications and alterations insofar as they come within the scope of the appended claims or the equivalents thereof.

Having thus described the preferred embodiments, the invention is now claimed to be:

1. A vacuum pump comprising:

a pump unit with a vacuum pumping set, an operating unit connected with the pump unit for controlling the pump unit and arranged spaced from the pump unit, and transceiver modules in the pump unit and the operating unit, respectively, for transmitting and receiving control and operational data bidirectionally in a wireless manner, the pump unit and the operating unit being exclusively connected with each other in a wireless manner, wherein the pump unit comprises:

a pump control and a supervisory module for continuous supervision of the transceiver module even if no control or operational data at all are exchanged between the pump unit and the operating unit, the supervisory module regularly inducing the transceiver module at intervals of a few seconds at maximum to emit a presence signal, the pump control switching the pumping set to a safety mode when the supervisory module signals an interruption of the reception of a control signal continuously transmitted by the transceiver module of the operating unit.

2. The vacuum pump of claim 1, wherein the operating unit comprises:

a supervisory module continuously supervising the reception of the transceiver module and continuously inducing the transmission of the control signal to the pump unit when a fault-free reception is detected.

3. The vacuum pump of claim 1, wherein the transceiver modules include radio modules via which a radio link between the pump unit and the operating unit is established.

4. The vacuum pump of claim 1, wherein the transceiver modules are infrared modules via which an infrared link between the pump unit and the operating unit is established.

5. The vacuum pump of claim 1, wherein at least one of the pump unit and the operating unit includes a wireless telephone module.

6. The vacuum pump of claim 1, wherein at least one of the pump unit and the operating unit includes a position determination module.

7. A vacuum pump comprising:

a) a plurality of vacuum pump units, each vacuum pump unit including:

a vacuum pump, an electronic vacuum pump control module for controlling operation of the vacuum pump, a transceiver module for receiving control signals from a control unit and for sending the information signals wirelessly from the vacuum pump control module to the control unit;

b) an operating unit including:

the control unit which controls the plurality of vacuum pump units, a manual input system through which instructions are entered into the control unit, a display, and a transceiver module which (a) sends wireless control signals to each of the plurality of vacuum pump units, (b) at regular intervals, sends signals in addition to the control signals to induce each of the plurality of vacuum pump units to emit a presence signal, (c) receives wireless information signals from each of the plurality of pump units, and (d) receives presence signals different from the information signals from each of the plurality of pump units.

8. The vacuum pump of claim 7, further including:

a supervisory module connected with the control module of at least one of the central control unit control module and the vacuum pump control module for causing the vacuum pump to enter a safety mode in response to an interruption in communications between the central control unit and the vacuum pump unit.

9. The vacuum pump of claim 7, wherein the control unit further includes:

a telephone module for sending maintenance and control data from the operating unit to a maintenance center.

10. The vacuum pump of claim 9, wherein the telephone module operates under one of a GSM, HDCSD, GPRS, or UMTS standard and the central control unit and vacuum pumping unit transceiver modules operate according to a wireless LAN IEEE 802.11 standard.

11. The vacuum pump of claim 7, wherein each vacuum pump unit further includes:

a GPS module which determines a location of the vacuum pumping unit, the GPS module being connected with the vacuum pump control module for communicating vacuum pumping unit position information to the central control unit.

* * * * *